United States Patent [19]

Harris et al.

[11] 4,363,257

[45] Dec. 14, 1982

[54] STRIKEDOWN SERVICE MECHANISM FOR A VERTICAL LAUNCHING SYSTEM

[75] Inventors: Robert M. Harris, New Hope; Edward R. Betzold, Golden Valley, both of Minn.

[73] Assignee: FMC Corporation, Chicago, Ill.

[21] Appl. No.: 153,995

[22] Filed: May 28, 1980

[51] Int. Cl.[3] ..... F41F 3/04; F41F 9/00

[52] U.S. Cl. ..... 89/1.802; 89/1.805; 414/140; 414/282; 414/283

[58] Field of Search ..... 89/1.8, 1.801, 1.802, 89/1.803, 1.804, 1.805; 414/140, 282, 283, 281, 266, 267, 22

[56] References Cited

U.S. PATENT DOCUMENTS

| | | | |
|---|---|---|---|
| 2,981,152 | 4/1961 | Miller et al. | 89/1.805 |
| 3,065,673 | 11/1962 | Hereth | 89/1.805 |
| 3,113,486 | 12/1963 | Kongelbeck | 89/1.802 |
| 3,166,976 | 1/1965 | Bauer et al. | 89/1.805 |
| 3,228,293 | 1/1966 | Kane et al. | 89/1.8 |
| 3,262,366 | 7/1966 | Bauer et al. | 89/1.8 |
| 3,951,282 | 4/1976 | Keller | 414/282 X |
| 4,027,800 | 6/1977 | Polen | 414/140 X |
| 4,079,904 | 3/1978 | Groskopfs et al. | 414/283 X |

*Primary Examiner*—David H. Brown

*Attorney, Agent, or Firm*—H. M. Stanley; R. B. Megley

[57] ABSTRACT

A service mechanism for a shipboard missile vertical launch system has a base assembly which rides on a set of parallel tracks spanning a missile housing array. A carriage assembly is mounted for movement along the base assembly in a direction normal to the tracks. A portion of the carriage assembly is disposed for 360° rotation about a vertical axis. A cradle elevator is mounted for movement on vertically running tracks on the rotatable portion of the carriage assembly. A cradle is adapted to engage and hold a missile cannister and is rotatably mounted on the cradle elevator to dispose the missile cannister with its long axis in either a vertical or a horizontal position. The cradle includes a hoist pawl which is adapted to engage one end of the missile cannister to raise or lower the cannister in the cradle when the long axis is disposed vertically. The base assembly is hinged intermediate its ends so that when the vertical launching system is not being serviced the carriage assembly may be positioned adjacent to one end of the base assembly and the other end of the base assembly may be folded upwards to lie alongside the carriage assembly. With the cradle elevator lowered and the cradle disposed in a vertical condition, the base assembly is secured to an elevator which lowers the serice mechanism to a stowed position below the ship's deck.

27 Claims, 22 Drawing Figures

FIG_4
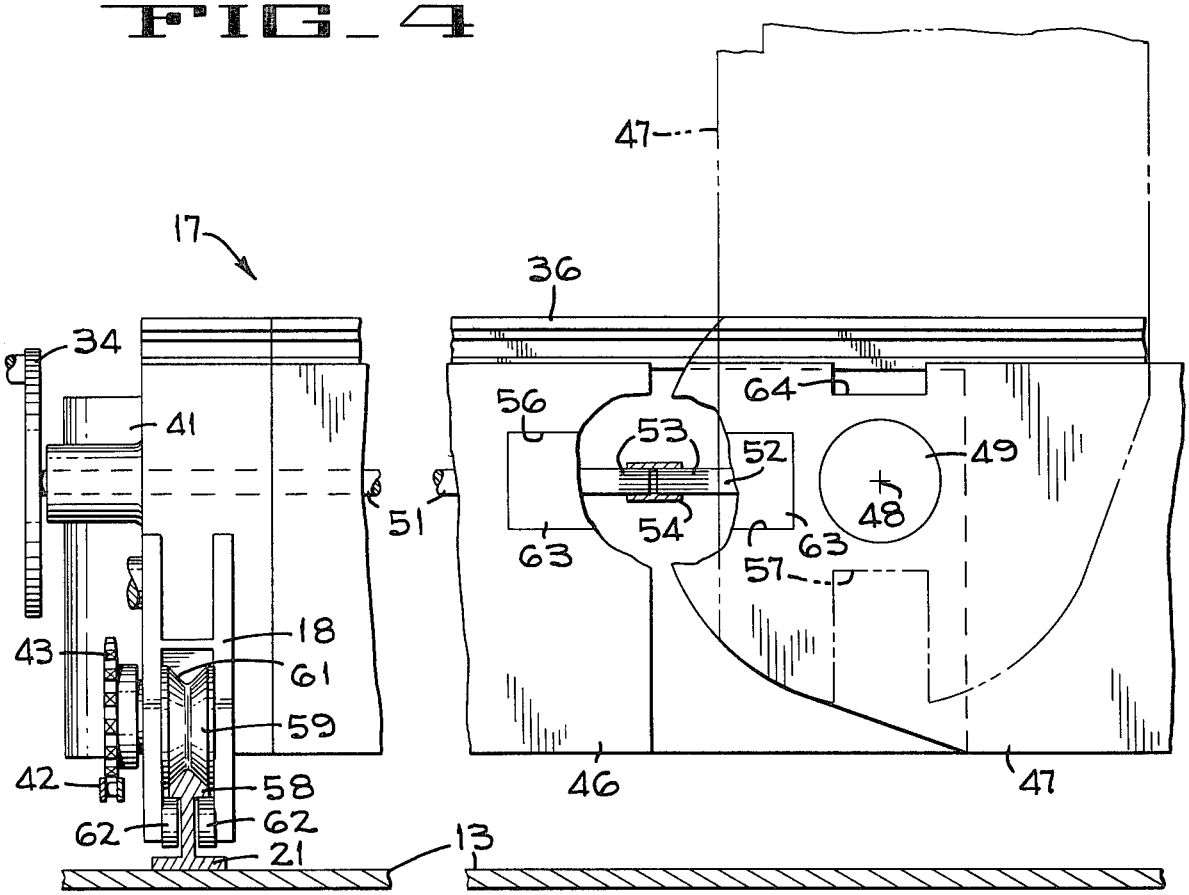
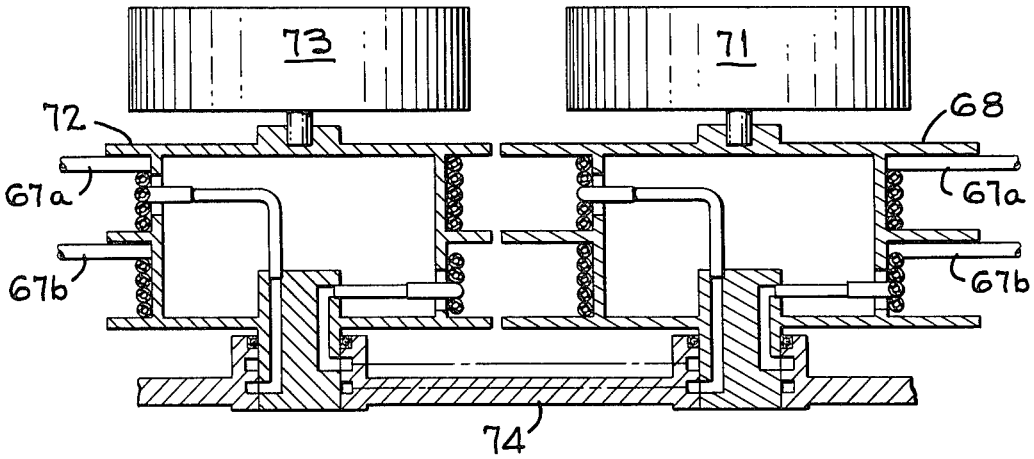
FIG_5

STRIKEDOWN SERVICE MECHANISM FOR A VERTICAL LAUNCHING SYSTEM

BACKGROUND OF THE INVENTION

1. Field of the Invention

This invention relates to a service mechanism for a vertical missile launching system and more particularly to such a service mechanism which is configured to assume a stowed mode when not servicing the vertical launching system in an operational mode.

2. Description of the Prior Art

Missile handling and launching systems are known which are suitable for either stationary installations or installations which are carried on board ship. The missiles, which are guided toward their intended targets, take a number of forms. For example, the guided missiles seen in U.S. Pat. Nos. 3,228,293, Kane et al, U.S. Pat. No. 3,262,366, Bauer et al, and U.S. Pat. No. 3,166,976 Bauer et al show a separate missile and a booster rocket which is attached thereto with stabilizing fins on both the missile and booster sections. Later developed missiles are provided in completely assembled configuration within so-called "missile cannisters" which are shaped to enter missile housings for ultimate firing from the cannisters within the housings.

A missile handling system is disclosed in the Kane et al '293 patent which includes a pair of spaced hoists each of which has a rail along which missiles are moved. Each hoist is serviced by a stowage mechanism for the missiles and apparatus is provided for moving the missiles from the stowage mechanisms both to and from the hoists. The hoist rails extend upwardly to cooperate with matching rails carried on a launcher arm. A spanner portion of the hoist rail is pivotally mounted to assume a position behind the launcher after missile and booster have been loaded onto the launcher rail. A plate like member is attached to the spanner portion to take up a position behind the booster on the launch arm to act as a blast door. The blast door receives the impact of the burning gases projected from the missile booster when it is fired. The launcher arm is movable in elevation and is carried on a rotatable pedestal for training the missile in azimuth.

The disclosure in U.S. Pat. No. 3,262,366 Bauer et al, relates to a ready service mechanism which induces a number of assembled missiles and boosters in an unarmed state and without aerodynamic surfaces yet attached. The missile-booster combinations are stowed in steel trays which operate both to handle the missile weapons and also to damp out certain detrimental vibrations which may be generated by ship's machinery when the weapons system is installed aboard ship. The service mechanisms operate to provide a selected one of a number of different missile-booster combinations (i.e. conventional or atomic warheads) to the loader rails of a feeder system. The feeder system transports the selected missile-booster weapon combination to a launcher. The feeder system includes the spanner rail and the blast door configuration described hereinbefore in conjunction with the Kane et al '293 patent.

A loader mechanism for a guided missile launching system is disclosed in the Bauer et al U.S. Pat. No. 3,166,976. As disclosed therein handling and launching systems for missile type weapons wherein a series of weapons is delivered to a launcher usually include a magazine and a feeder mechanism for carrying the missiles from the magazine to the launcher. The magazine may be broken down into what is termed a ready service magazine wherein final assembly steps and arming of the missile weapon takes place and stowage magazines where missile weapon components are stored and from which such weapons are drawn to replenish the ready service magazine. The Bauer et al '976 disclosure relates primarily to a loader which horizontally conveys missile booster combinations from an area where the combinations are joined to an area where missile wing and fin assembly and arming of the missiles is carried out. Following these preliminary flight preparations the complete weapons are transferred by way of a floating span track assembly to the arms of a launcher. The floating span track is attached to a blast door which is closed during firing operation of a missile booster combination from the launcher so as to seal off the preliminary flight preparation area from the launcher during firing. The loader disclosed operates to convey missiles away from the launcher arms in the event of misfiring or during exercise cycle as well as operating to deliver missile weapons to the launcher arms for firing therefrom.

The foregoing relatively brief descriptions to these extensive patent writings are undertaken to illustrate the distinctions between the most pertinent missile handling systems currently known in this field and the system to be hereinafter described.

SUMMARY OF THE INVENTION

The invention disclosed herein relates to a service mechanism which is constructed to interface with a vertical launching system which has an array of missile housings in which missiles are stored in a launching condition. The service mechanism has a base assembly which is movable bi-directionally over the array of missile housings when in an operational condition. One end of the base assembly is movable relative to the other end to assume a stowed condition. A carriage assembly is mounted to move bi-directionally on the base assembly when the base is in the operational condition so that through the combination of carriage and base assembly movements the carriage may be positioned proximate to each missile housing in the array. A cradle assembly is mounted on the carriage in a fashion to provide movement of the cradle assembly relative to the carriage. The cradle assembly is configured to securely engage a missile and to provide for raising and lowering thereof so that the missile may be moved between a receiving position displaced to one side of the array and ones of the missile housings.

BRIEF DESCRIPTION OF THE DRAWINGS

FIG. 4 is an enlarged section taken along the line 4—4 of FIG. 3.

FIG. 5 is an enlarged section taken along the line 5—5 of FIG. 3.

DESCRIPTION OF THE PREFERRED EMBODIMENT

Figure 1:
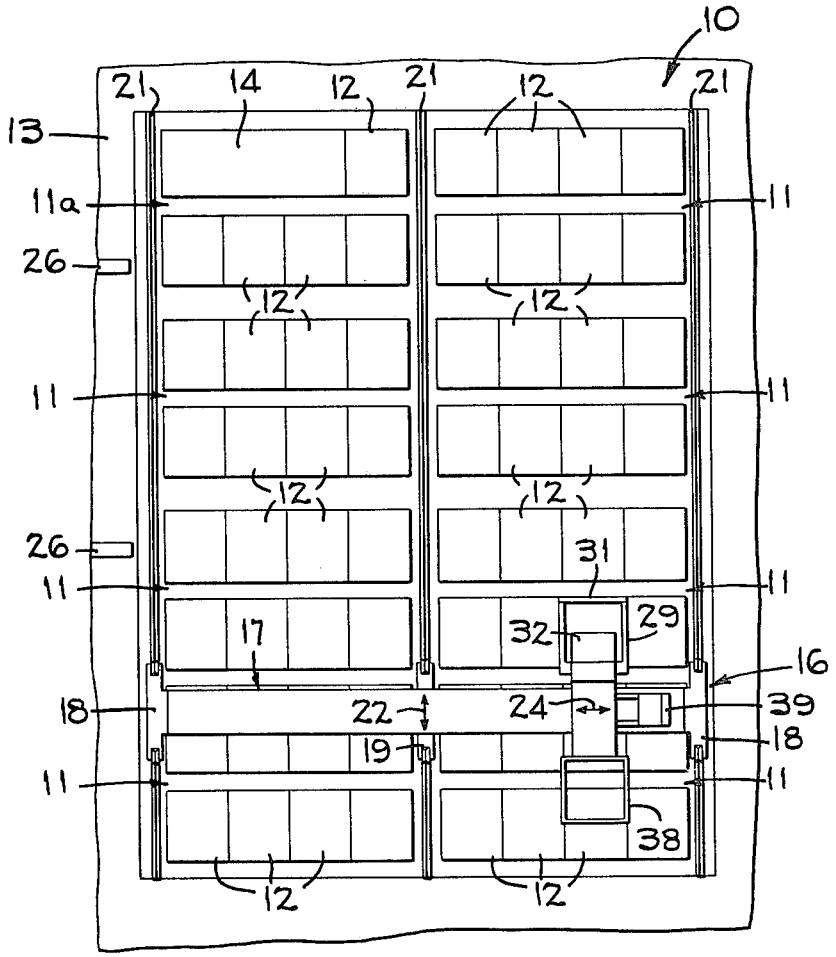
FIG. 1 is a plan view of a vertical launch system with the servicing mechanism overlying the system in the operational mode.

The invention disclosed and claimed herein relates to a mechanism for servicing a vertical launch system for missile weapons. One type of vertical launch system is shown generally at 10 in FIG. 1. The system may be constructed in a fixed geographical position, but more often is seen constructed as a mobile installation such as on board ship. The launch system is laid out in a rectangular array containing a number of modules 11 each of which contains eight missile housings 12 in this particular configuration. The modules are sunk into a deck 13 of a missile carrying ship so that the tops of the modules extend about six inches above the level of the deck. As depicted in FIG. 1 there are seven modules 11 containing eight housings each and one module 11*a* (which may be located wherever convenient in the module arrangement) containing five missile housings 12. A cover 14 is shown in module 11*a* covering the volume which would be defined by three of the missile housings. The cover overlies the volume in which a service mechanism (shown generally at 16 in the operational mode in FIG. 2) is stored when the service mechanism is configured in what is termed the stowed mode.

Each of the missile housings 12 is configured to accept a missile cannister. The cannister is a tube-like structure which, in one configuration, is approximately 26 by 26 inches square and about 22 feet long. It may be seen that the array shown in FIG. 1 may therefore house sixty-one missile cannisters while alotting the volume of three of the missile housings for storage of the service mechanism when it is not in use. Each missile housing has an upper hatch in this particular launching system which may be powered to an open position for loading and unloading and for launching of the missiles from the cannisters. The loading and unloading is accomplished through the use of the service mechanism 16 when it is assembled to assume the operational mode. The remainder of this description will dwell primarily on the details of the service mechanism and how it is erected, utilized to interfere with the vertical launching system and stowed in its appointed storage volume.

As further seen in the plan view of FIG. 1 the service mechanism 16 overlies the rectangular array of missile housings 12 having a base 17 with a set of rollers 18 on each end thereof and a third set of rollers 19 disposed approximately midway between the ends. The rollers are configured to run on a set of three parallel tracks 21 which are disposed on each side of and centrally through the vertical launching system array so that the base may travel in the direction (usually fore and aft aboard ship) indicated by the arrow 22.

A carriage 23 is movably mounted on the base 17 for movement thereon in the direction (athwartships) indicated by the arrow 24. The carriage supports structure, to be hereinafter described in greater detail, for movement thereon which is adapted to engage and transport the missile cannisters from a receiving point adjacent one side or the other of the array of missile housings to ones of the missile housings 12 for loading or in a reverse direction for unloading. A set of support chocks 26 are seen in FIG. 1 which serve to support the missile cannister at the receiving point. It may thus be seen that the structure for transporting missile cannisters may be addressed to any one of the missile housings 12 in the rectangular array. It should be understood that while the missile transport structure is hereinafter described in terms of that required to transport the aforedescribed missile containers, such structure may take on any specific form adapted to transport missiles configured in any shape or size package.

Figure 2:
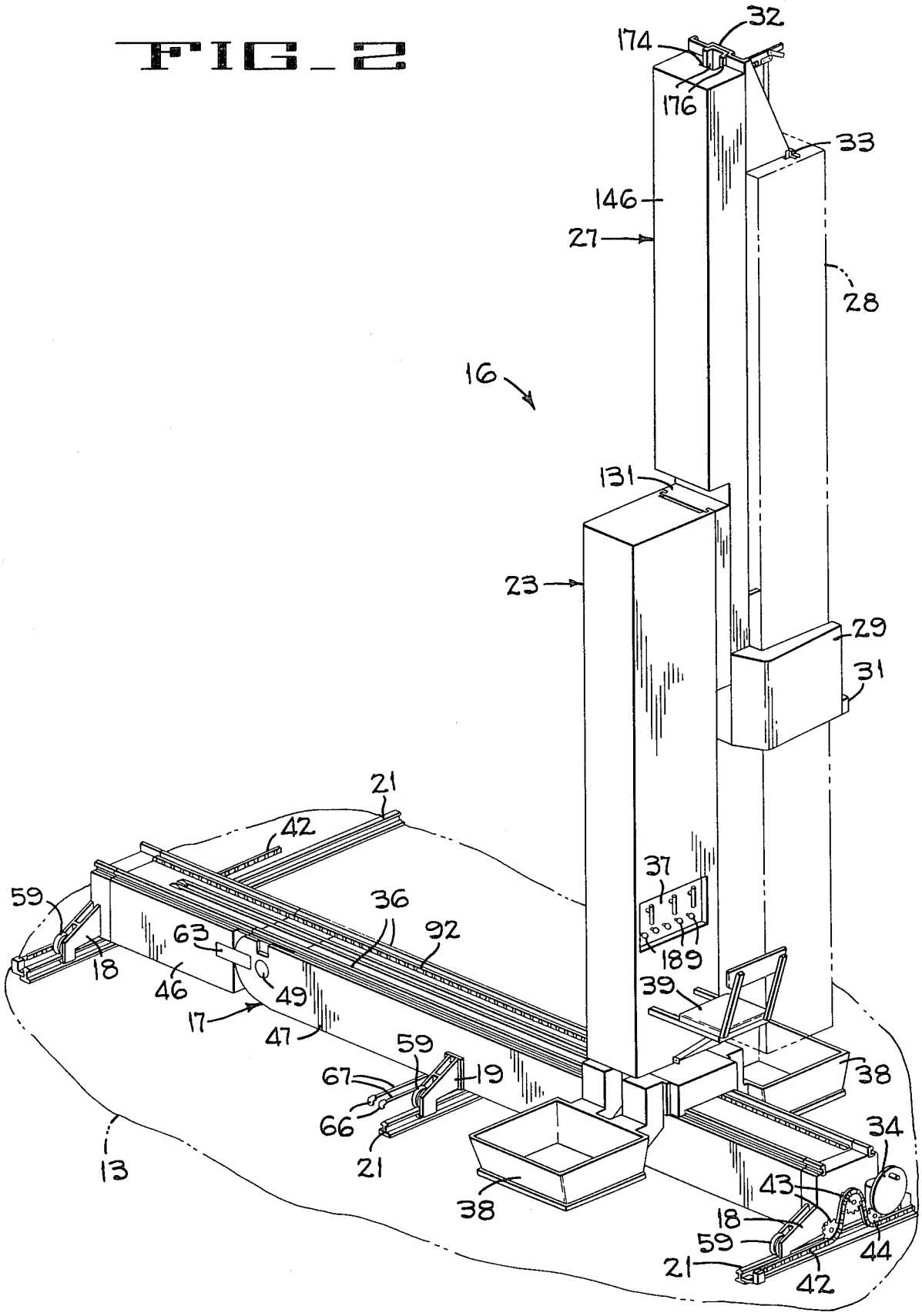
FIG. 2 is a dimetric view of the service mechanism of the present invention.

The service mechanism 16 is shown in FIG. 2 in the assembled operational mode. There are three basic components included in the service mechanism, namely the base assembly 17, upwardly projecting carriage assembly 23 mounted on the base assembly and a cradle assembly 27 mounted on the carriage assembly. A missile cannister 28 is shown in phantom lines engaged by the cradle assembly. The missile cannister is surrounded at a point intermediate its ends by a fork 29 and a releasable cross bar 31 extending across the ends of the fork. The cannister is slidable within the confines of the fork and the cross bar and is attached at its upper end to a hoist pawl 32 which has a pair of outwardly spring loaded forks 33 (one shown in FIGS. 2 and 13) which extend around the shanks and under the heads of a pair of broad headed studs (not shown) fixed on top of the cannister.

As explained hereinbefore the base assembly 17 in its extended operational position as shown in FIG. 2 is disposed for movement along the tracks 21 on the deck 13 by means of the end rollers 18 and the mid-roller set 19. The base is urged to move along the tracks 21 by manual engagement of a crank wheel 34 one of which is located in accessible position on each end of the base. The upright carriage assembly 23 is free to move along the base on tracks 36 formed atop thereof. The carriage assembly is driven hydraulically by proper control selection at a control panel 37 shown in FIG. 2. A detachable operator's chair 39 is shown attached to the side of the carriage assembly so that an operator may comfortably assume a position at the control panel. A pair of funnels 38 are shown carried on either side of the lower portion of the carriage assembly 23 which function to funnel the lower end of the missile cannister 28 when it is being lowered by the cradle assembly into one of the missile housings. The cradle assembly 27 is driven hydraulically in an upward and downward direction relative to the carriage and provides rotational orientation of the missile cannisters so that the missile cannisters may be raised and lowered and the missile long axis may be disposed in either a vertical or a horizontal position.

Figure 3:
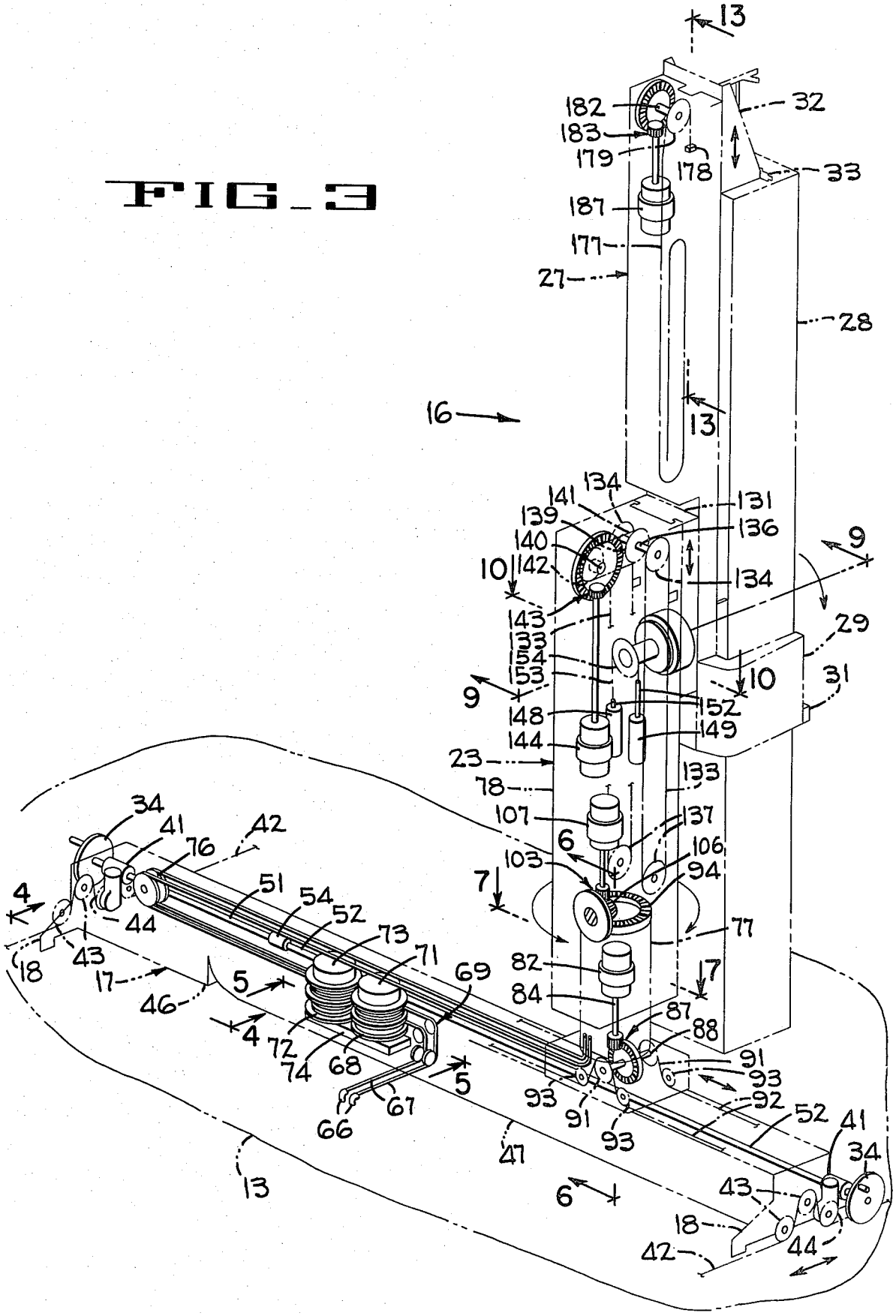
FIG. 3 is a cut-away dimetric view of the service mechanism of the present invention.

The cut-away view of FIG. 3 is useful for showing the positions, structure and inter-relations of the various drives for movement attainable by the service mechanism 16. The hand cracks 34 are discernable at each end of the base 17. The hand cranks extend from a shaft which enters a worm gear reduction box 41 on each of the end roller sets 18. As seen in FIG. 2 a sprocket chain 42 is anchored at each end of each of the outside parallel rails 21 and is passed around a pair of idler sprockets 43 on each of the end roller sets as well as around a driven sprocket 44 at the output of the gear reduction box 41. While the base 17 is driven along the tracks 21 by manual actuation of one or both of the hand cranks 34, it should be realized that the base could as readily be driven along the tracks in a manner similar to that just described by providing a power drive controllable by an operator at control panel 37.

Referring to FIG. 4 the base assembly 17 is configured at a point intermediate the ends thereof so that a longer base end section 47 pivots relative to a shorter base section 46 about a pivot point 48. The long and short base end sections are attached at the pivot point by a sturdy pivot pin 49. The shaft which couples the crank wheel 34 to the gear reduction box 41 is seen to pass through the gear box (dashed lines). This is typical at each of the gear reduction boxes and the shafts each extend inwardly along the length of the base assembly 17. A short inwardly projecting hand crank shaft section 51 projects from the gear reduction box 41 on the end roller set 18 on the short base end section and a longer hand crank shaft extension 52 extends inwardly from the gear reduction box on the end roller set attached to the long base end section. Each of the short and long hand crank shaft extensions terminate at their inner ends in a splined section 53. A sliding splined coupling 54 is positioned on the splined end section of the long hand crank shaft extension 52 so that the sliding splined coupling may be moved axially to engage the splined section on the end of the short hand crank shaft extension 51 when the short and long base end sections 46 and 47 are in the aligned operational position as seen in FIGS. 2 and 3 and in solid lines in FIG. 4. The ends of the hand crank shaft extensions and the splined coupling are accessible through a pair of aligned keyways 56 and 57 in the short and long base end sections respectively. Consequently, it may be seen that manual rotation of either of the hand wheels 34 will cause the base assembly 17 in the operational mode to traverse along the set of parallel tracks 21.

The set of parallel tracks 21 have an inverted T-shape in cross section. An upper rail 58 on the T-shaped section has an inverted V-shape and provides outwardly extending flanges as shown. The roller sets 18 and 19 carry main rollers 59 having V-shaped grooves 61 therein substantially conforming to the shape of the upper rails 58. The roller sets also include underlying small cylindrical rollers 62 which extend underneath the flanges provided by the V-shaped upper rails 58. In this fashion the rails 21 are captured by the roller sets so that pitching motions of the deck 13 will not fling the rollers off of the tracks.

As shown in FIG. 4 in solid lines the long base end section 47 when in the extended operational position provides alignment between its keyway 57 and the keyway 56 carried on the short base end section 46. A rectangular key 63 is formed to be placed in and to extend between the keyways 56 and 57 and serves to lock the two base end sections in the operational position. When the long base end section 47 is rotated on the pivot pin 49 to assume an upwardly extending stowed position, by means and for purposes to be hereinafter decribed, another keyway 64 on the long base end section at a position 90° about the pivot point 48 from the keyway 57 is brought into alignment with the keyway 56 on the short base end section 46. In such an instance the key 63 is placed in position extending between the keyways 56 and 64 so that the long base end section 47 is locked in the upwardly extending or stowed position as shown in phantom lines in FIG. 4.

Referring again to FIG. 3 the deck 13 may be seen to have projecting therefrom a pair of swivel type hydraulic fittings 66 which provide a pressure hydraulic coupling and a return or tank hydraulic coupling. Hydraulic pressure is used in the preferred embodiment for driving various portions of the service mechanism 16 although it will be understood by those of skill in this art that electrical or pneumatic power sources could be used to accomplish that which will be described hereinafter as accomplished hyraulically. A pair of hydraulic lines 67 having quick disconnect end couplings thereon extend from the long base end section 47 of the base assembly 17. The lines 67 must be played out and retrieved as the base assembly travels bi-directionally on the set of parallel tracks 21 and as the long base end section is positioned between the stowed and operation positions. Hydraulic pressure must also be transferred to the carriage and cradle assemblies 23 and 27, as will hereinafter become apparent, so that the hydraulic lines must also be played out and retrieved as the carriage assembly 23 is caused to traverse along the length of the base assembly 17. The means for accomplishing the hydraulic pressure transfer with the foregoing described motions will now be described with reference to FIG. 5. A deck reel 68 is shown in FIG. 5 to which the hydraulic lines 67 are led via an appropriate system of guide pullies such as generally illustrated at 69 (FIG. 3). The reel 68 is of a conventional type having a spring motor 71 which urges the reel in a direction to wind the pressure line 67*a* (FIG. 5) onto an upper portion thereof and to wind the tank hydraulic line 67*b* onto a lower portion thereof. The spring motor 71 is such as to allow the hydraulic lines 67*a* and 67*b* to be pulled off of the reel against the spring motor when it is necessary to play out hydraulic line and to collect the hydraulic lines onto their respective reel portions when the lines are being retrieved.

A carriage reel 72 is mounted within the long base end section 47 having a spring motor 73, wherein the reel and spring motor are substantially the same as the deck reel 68 and spring motor 71. The two reels have a common base 74 containing passages for transferring hydraulic pressure from the upper portion of the deck reel to the upper portion of the carriage reel and for transferring the return or tank pressure from the lower portion of the carriage reel to the lower portion of the deck reel. The lines leading off of the carriage reel 72 are brought around an idler pulley 76 (FIG. 3) and then back along the short and long base end sections 46 and 47 directed upwardly to the carriage assembly 23. The carriage reel 72 and its spring motor 73 operate to play out pressure and return hydraulic lines 67*a* and 67*b* respectively when the carriage is moved toward the right end of the base assembly 17 as seen in FIG. 3 and to retrieve the lines on the reel when the carriage assembly is moved toward the left end of the base as seen in FIG. 3.

Figure 6:
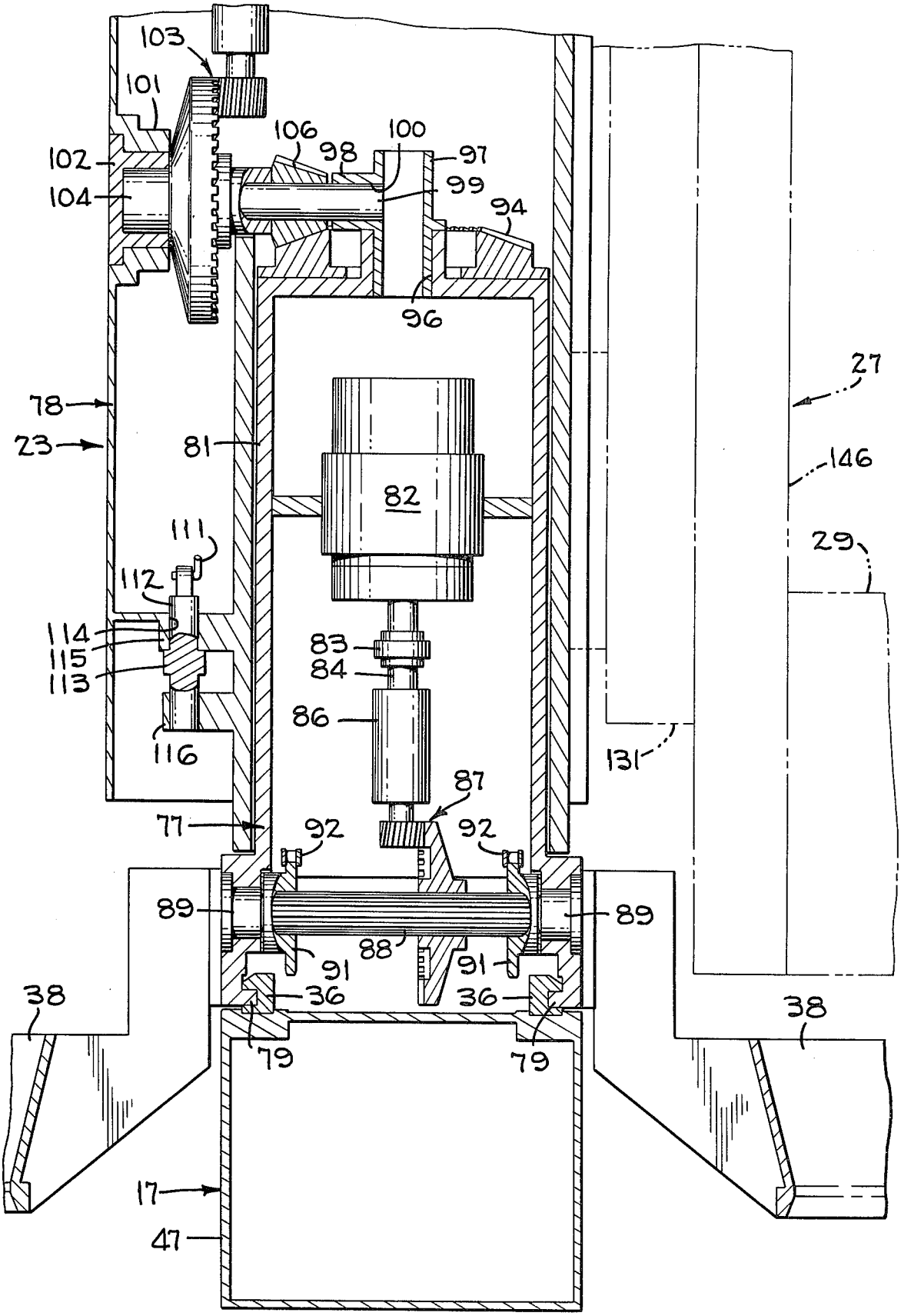
FIG. 6 is an enlarged section taken along the line 6—6 of FIG. 3.

The details of the carriage assembly 23 are best seen with reference to FIG. 6. The carriage assembly has a lower carriage portion 77 and an upper carriage portion 78. The lower carriage portion has inwardly extending flanges 79 on both sides thereof which mate with a groove in the track 36 extending along the top of the base assembly 17. Thus, the lower carriage portion 77 is disposed for sliding motion along the length of the base.

The lower carriage portion 77 is seen in FIG. 6 to have an upwardly extending cylindrical projection 81 on the inside of which is mounted a lower carriage hydraulic drive motor 82. The output shaft from the hydraulic motor 82 is attached through a coupling 83 to a shaft 84 extending through a bearing block 86 mounted inside the lower carriage portion. Attached to the lower end of the driven shaft 84 is one portion of a skew axis gear set 87 such as those commonly known in the industry as Spiroid or Helicon gear sets. A driving pinion member is meshed with a larger driven gear member of the skew axis gear set 87. The driven gear member is mounted on a splined shaft 88. The shaft is mounted in bearing blocks 89 mounted in the walls of the lower carriage 77 at each end of the shaft. A pair of drive sprockets 91 are also mounted on the splined shaft 88. A chain 92 (also seen in FIG. 2) is mounted along the length of each of the tracks 36 along the top of the base assembly 17. The chains are fixed at each end of the base assembly. The chains are led over the top of the drive sprockets 91 and underneath a pair of idler sprockets 93 (FIG. 3) so that as the drive sprockets are driven by the motor 82 through the skew axis gear set 87 the lower carriage will traverse the length of the base assembly. It should be noted that the hydraulic motor 82 is of the type wherein a brake is applied to the output shaft when the motor is de-energized. Consequently, the lower carriage 77 is locked in position on the base assembly 17 when the carriage is not being driven by the motor along the length of the base.

The upper portion 78 of the carriage assembly 23 is seen in FIG. 6 to be mounted on the upwardly extending projection 81 on the lower carriage for rotation about a generally vertical axis through the center of the cylinder formed by the projection. Fixed to the top of the upward projection on the lower carriage 77 is a bevel gear 94. A bearing bore 96 is formed in the center of the upward projection 81 and a bearing post 97 is inserted in the bore for rotation therein. The post has a boss 98 extending laterally therefrom and a shaft 99 is mounted within a bore 100 in the boss. One wall of the upper carriage portion 78 has a bearing boss 101 formed therein which contains a flanged bearing 102. One portion of another skew axis gear set 103 has a stub shaft 104 extending from the rear side thereof which is formed to fit within the bearing 102. A bevel gear 106 is centrally attached to the front face of the one portion of the skew axis gear set 103 and is supported by the shaft 99 and rotates thereon. The skew axis gear set 103 is driven by another hydraulic motor 107 (FIG. 3) which drives the upper portion 78 of the carriage assembly rotationally about the vertical axis extending through the lower carriage portion 77 as the bevel gear 106 "walks around" the fixed bevel gear 94 on the carriage lower portion. It should be noted that the hydraulic motor 107 does not incorporate a shaft brake when the motor is at rest because the upper carriage portion 78 is latched in position 90° increments by means of structure to be hereinafter described.

Figure 8:
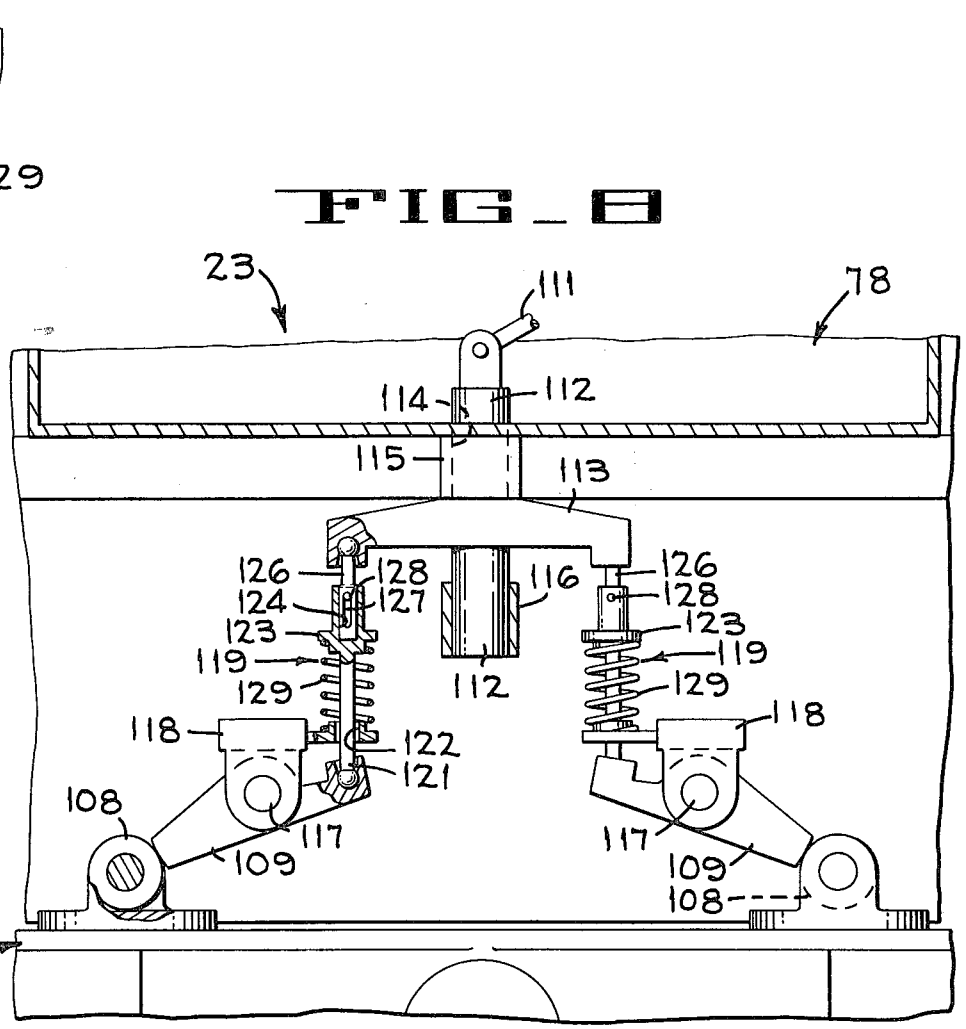
FIG. 8 is a section taken along the line 8—8 of FIG. 7.
Figure 7:
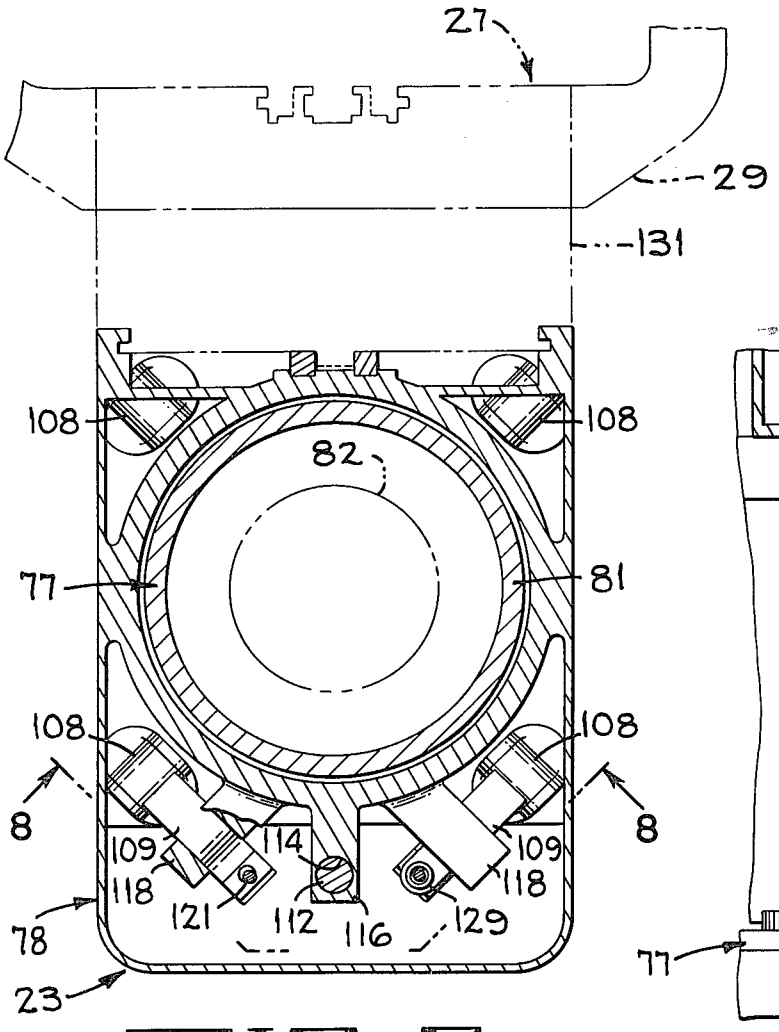
FIG. 7 is an enlarged section taken along the line 7—7 of FIG. 3.

With reference now to FIG. 7 of the drawings the mechanism for latching the upper carriage 78 in rotational position at 90° increments is shown. Four latch rollers 108 are shown disposed 90° apart around the vertical axis of rotation of the upper carriage. The four latch rollers are mounted on the upper surface of the lower carriage 77. A latch release mechanism is shown in FIG. 8 which selectively positions a pair of latching members 109 to either fix the upper carriage rotationally with the latch rollers engaged by the latch members, or to disengage the latch members from the latch rollers to allow the hydraulic motor 107 (FIG. 3) to rotate the upper carriage 78. The latch release mechanism is actuated from the control panel 37 by means of linkage including a rod 111 (FIG. 8) which when moved in a release direction depresses a cylindrical member 112 to which it is pivotally attached at the upper end. The cylindrical member has attached thereto a cross arm 113 and is guided in its upward and downward travel in a bore 114 within one wall of the upper carriage 78. The travel of the cylindrical member along its axis is stopped at the upper end by contact of the cross arm with a boss 115 on the bottom portion of the wall through which the bore 114 extends. Travel of member 112 is stopped at the bottom end by contact with a stop member 116 surrounding the cylindrical member and attached to the upper carriage. A pivot pin 117 is passed through a bracket 118 attached to the upper carriage 78 and through each of the latch members 109. A composite rod shown generally at 119 extends from each end of the cross arm 113 to one end of an underlying latch member 109. The composite rods are fitted with ball joints in the cross arm and in the latch members so that universal action is provided and problems with binding of the mechanism are avoided. Each composite rod has a lower end 121 which extends through a hole 122 in the bracket 118 and which has an upper enlarged end including a flange 123 and a bore 124. The bore is formed to receive an upper rod end 126 which has an elongate slot 127 formed therein. A pin 128 passes through the walls forming the bore 124 on the lower rod end and also passes through the upper portion of the slot 127. A coil compression spring 129 is placed around the lower rod end between the bracket 118 and the flange 123.

As may further be seen with reference to FIG. 8, when the control rod 111 is actuated so as to depress the cylinder 112 composite rods 119 are depressed causing the latch member 109 to pivot about the pins 117 and to thereby clear the latch rollers 108. As the upper carriage 78 is caused to move by actuating the upper carriage rotation drive motor 107, the control rod 111 is released and the rotational latch mechanism returns to the condition shown in FIG. 8. However, the upper carriage may continue to rotate because the latch mechanism is rotating through an arc which does not contain any latch rollers 108. The trailing latch member 109 in the rotation will first contact a latch cylinder with the underside of the latch member. The slope presented by the underside of the latch member will cause the member to rotate about the pivot pin 117 as it rides up over the top of the latch roller. This rotation of the latch member will cause the lower rod end 121 to move downwardly against the compression spring 129. The lower rod end 121 will move downwardly relatively to the upper rod end 126 as the pin 128 migrates downwardly in the elongate slot 127. This allows the trailing latch member to ride up and over a latch roller without causing movement of the control rod 111 and the cylindrical member 112. When the trailing latch member has passed the latch roller the leading latch member will be just arriving at another latch roller displaced 90° therefrom. The compression spring 129 urges both latch members 109 into the latched configuration as shown in FIG. 8, whereby the upper carriage 78 can no longer be rotated in azimuth. It should be noted that a mechanical stop (not shown) is provided between the lower carriage and the upper carriage which allows only 360° of motion therebetween. This is for the purpose of preventing excessive "wind up" of the hydraulic lines as they are passed from the lower carriage to the control panel 37 mounted in the upper carriage.

Figure 9:
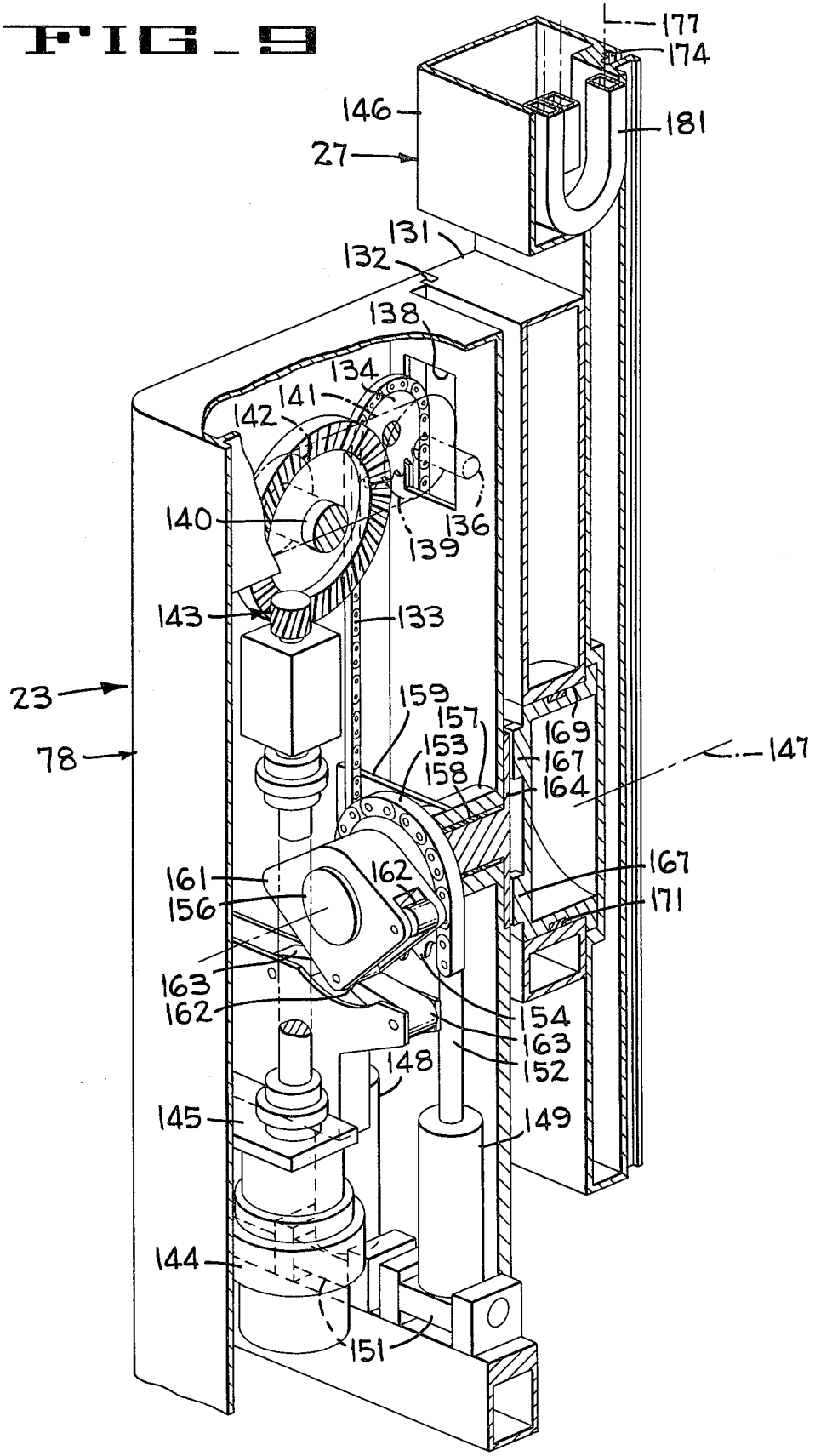
FIG. 9 is an enlarged perspective section taken along the line 9—9 of FIG. 3.

Referring now to FIGS. 3 and 9 it may be seen that a cradle elevator 131 is mounted to engage U-shaped tracks 132 formed on each edge of one side of the upper carriage 78. The cradle elevator is movable vertically along the one side of the upper carriage on the tracks. An endless chain 133 is brought around a sprocket 134 which is mounted for rotation on a shaft 136 extending across the upper carriage. A sprocket and chain similar to sprocket 134 and chain 133 is also mounted on the shaft 136 within that portion of the upper carriage 78 not shown in FIG. 9. These parts may be seen without detail in FIG. 3. Each of the endless chains 133 is brought around a lower idler sprocket 137, one of which is shown in FIG. 3. One reach of the endless chains 133 is brought through an opening 138 in the wall of the upper carriage adjacent to the cradle elevator and is brought back into the interior of the upper carriage at a similar opening adjacent to the lower idler sprocket. The reach of the endless chain which passes on the outside of the upper carriage is attached to the cradle elevator 131 so that the cradle elevator may be raised and lowered by moving the endless chains.

A center drive sprocket 139 (FIG. 9) is mounted on the shaft 136 which is driven through an endless chain 141. The chain 141 traverses around a sprocket 142 attached to a skew axis gear set 143 similar to those hereinbefore described. The sprocket 142 and the gear member of the skew axis gear set 143 are mounted on a shaft 140 which is fixed within the upper carriage 78. A hydraulic drive motor 144 is mounted in fixed position within the upper carriage by means of a mounting block 145 and drives the skew axis gear set through couplings and bearing blocks also similar to those hereinbefore described. As a consequence, the cradle elevator 131 is either raised or lowered by the resulting motion of the endless chains 133 in accordance with the direction of rotation selected for the hydraulic motor 144. It should be noted that this hydraulic motor has a brake which prevents motor shaft rotation when hydraulic power to the motor is shut off.

Figure 11:
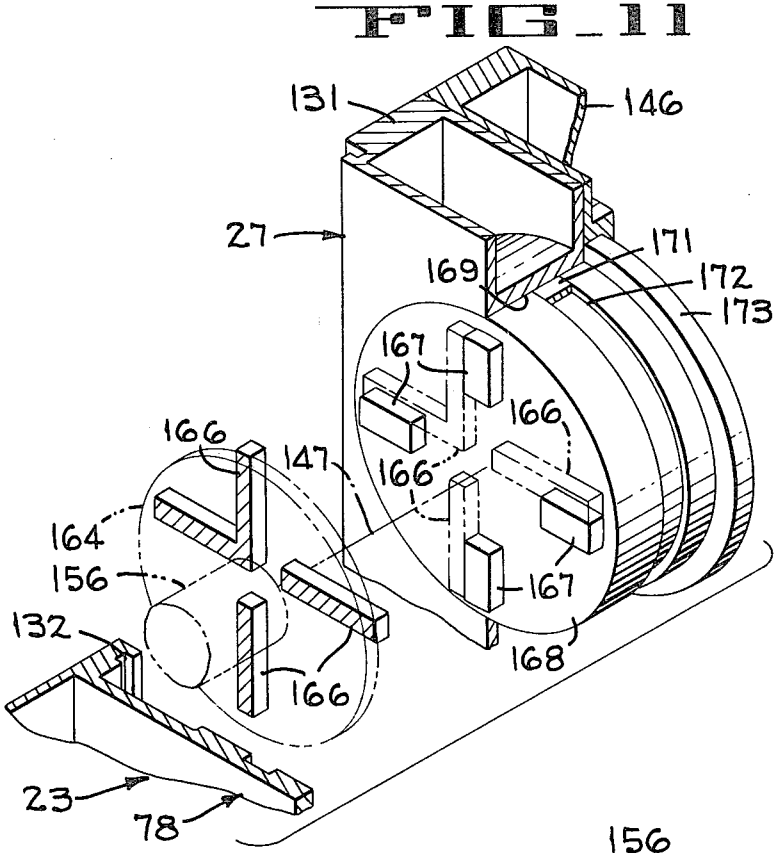
FIG. 11 is an exploded perspective view of a cradle rotational drive for the missile cannister cradle of the present invention.
Figure 12:
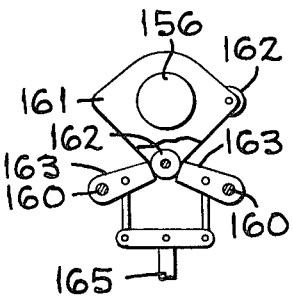
FIG. 12 is a partial side elevation view taken along the line 12—12 of FIG. 10.
Figure 10:
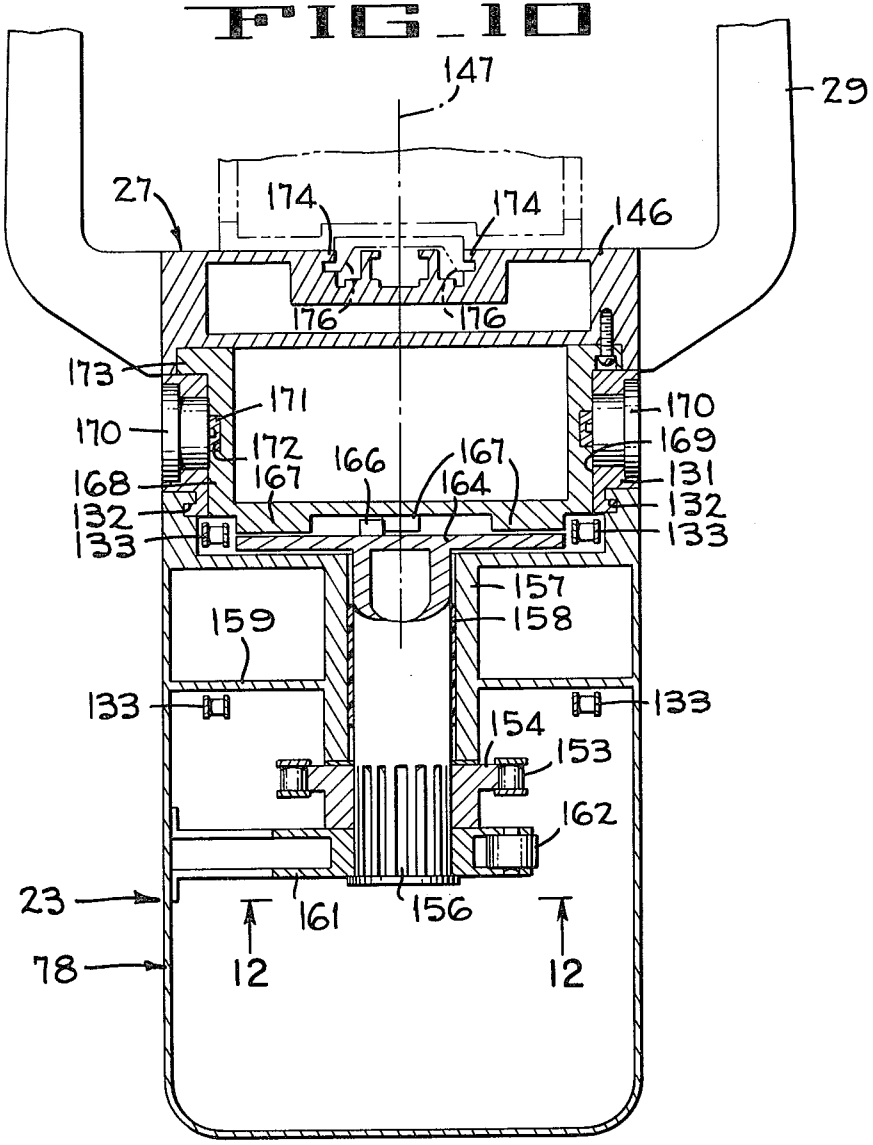
FIG. 10 is an enlarged section taken along the line 10—10 of FIG. 3.
Figure 19:
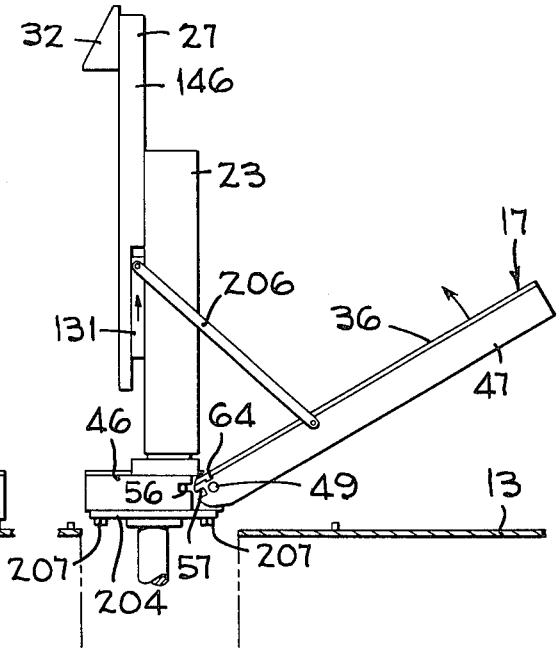
FIG. 19 is another side elevation view showing further steps in attaining a stowed configuration of the present invention.
Figure 20:
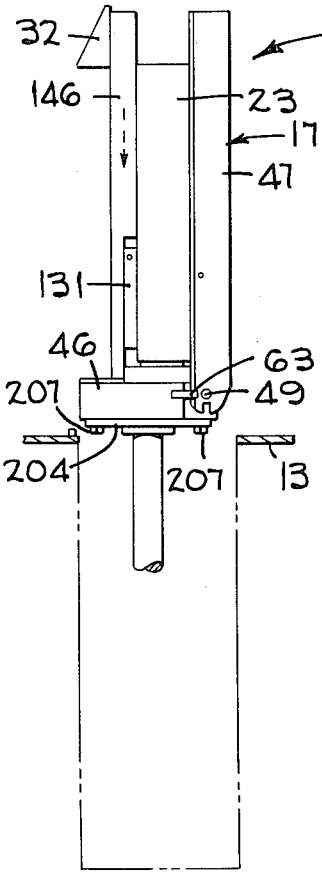
FIG. 20 is yet another side elevation view showing still further steps in attaining a stowed configuration of the present invention.

With reference now to FIGS. 9, 10 and 11 it may be seen that the cradle assembly 27 includes a cradle 146 which is attached to the cradle elevator 131 and which is disposed for rotational movement about an axis 147. The rotational drive is provided by a pair of pistons 148 and 149 which are mounted on similar mounting blocks 151 within the upper carriage 78. Each of the pistons has a rod 152 extending therefrom which is extended and retracted in accordance with the application of hydraulic pressure to the piston as controlled at the control panel 37. A drive chain 153 is attached to the end of one of the rods 152 and is led over a sprocket 154 and is connected to the end of the other rod 152. The sprocket 154 is mounted on a splined trunnion drive shaft 156 (FIG. 19) so that when the rod 152 is caused to retract within cylinder 149 the shaft 156 will rotate in one direction and when the opposite rod 152 is caused to retract within the piston 148 the shaft will be caused to rotate in the opposite direction. The trunnion drive shaft is mounted within a boss 157 formed within the upper carriage 78 on a bearing 158 made of some material such as *Teflon which is disposed between the inside surface of the boss and the shaft. Further support for the boss is provided by an internal web 159 formed within the upper carriage. On the end of the splined trunnion drive shaft a latch arm 161 is mounted in fixed rotational relation with the shaft. Two latch rollers 162 are mounted in the latch arm and are disposed 90° apart about the axis of the trunnion drive shaft. The drive shaft axis is coincident with the cradle rotation axis. One of the rollers is shown disposed downwardly in FIG. 9 where it is captured between two spring loaded latch members 163. As shown in FIG. 12 the latch members 163 are actuated between an up or engaged position and a down or disengaged position by means of a rod 165. The rod is urged in the upward or the downward direction by means of linkage attached to an appropriate control on the control panel 37. The latch members 163 are seen to pivot about the pivot pins 160 attached to the structure of the upper carriage to assume the latched and unlatched positions. It may thus be seen that the trunnion drive shaft is latched in one of two rotational positions spaced 90° apart as the latch members capture one of the two rollers 162 which are spaced 90° apart.

*Trademark

Figure 16:
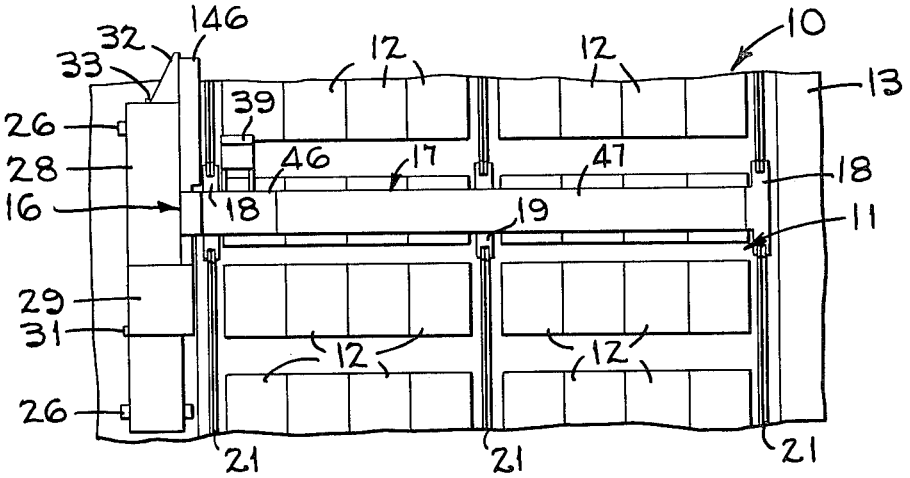
FIG. 16 is a partial plan view of a vertical launch system showing an operating configuration of the present invention.

The trunnion drive shaft 156 extends through the opening afforded in one wall of the upper carriage 78 by the bore through the boss 157 having a trunnion drive plate 164 formed on the extended end. The drive plate has formed thereon a pattern of raised stops 166 which are best shown in FIG. 11. The stops when driven rotationally contact a series of four keys 167 which are attached to the rear surface of a rotating trunnion 168 mounted in the cradle elevator 131. The stops are shown in phantom line adjacent to the keys in the exploded view of FIG. 11. The trunnion rotates within a bore 169 formed through the cradle elevator. A bearing 171 disposed in a groove 172 on the trunnion provides for easy rotation of the trunnion in the cradle elevator bore. The bearing is secured axially within the bore 169 by inserts 170 (FIG. 10), or some similar structure, which consequently secures the trunnion 168 axially in the bore. The cradle is affixed to a flange 173 on one end of the trunnion so that as the trunnion is rotated about the axis 147 to be latched at one of the two positions displaced by 90°, the cradle 146 is also displaced through 90° of arc. It may therefore be seen that the cradle 146 is capable of being positioned in an attitude where the long cradle axis is aligned vertically (as seen in FIGS. 3, 9 and 10) or in an attitude wherein the long axis of the cradle is aligned in a horizontal direction (as seen in FIG. 16). It should be noted that the cradle may only be rotated when the cradle elevator is raised to a position to align the axis of the trunnion with the axis 147 through the trunnion drive shaft. In all other elevation positions of the cradle elevator 131 the vertically aligned pair of keys 167 are caused to traverse an elongate slot (not shown) in the face of the wall on the upper carriage 78 which is adjacent to the cradle elevator. Therefore when the cradle has been rotated to align its long axis either vertically or horizontally and latched in such an attitude, the cradle elevator may be raised and lowered on the upper carriage with the cradle maintained in either the horizontal or the vertical attitude.

Figure 13:
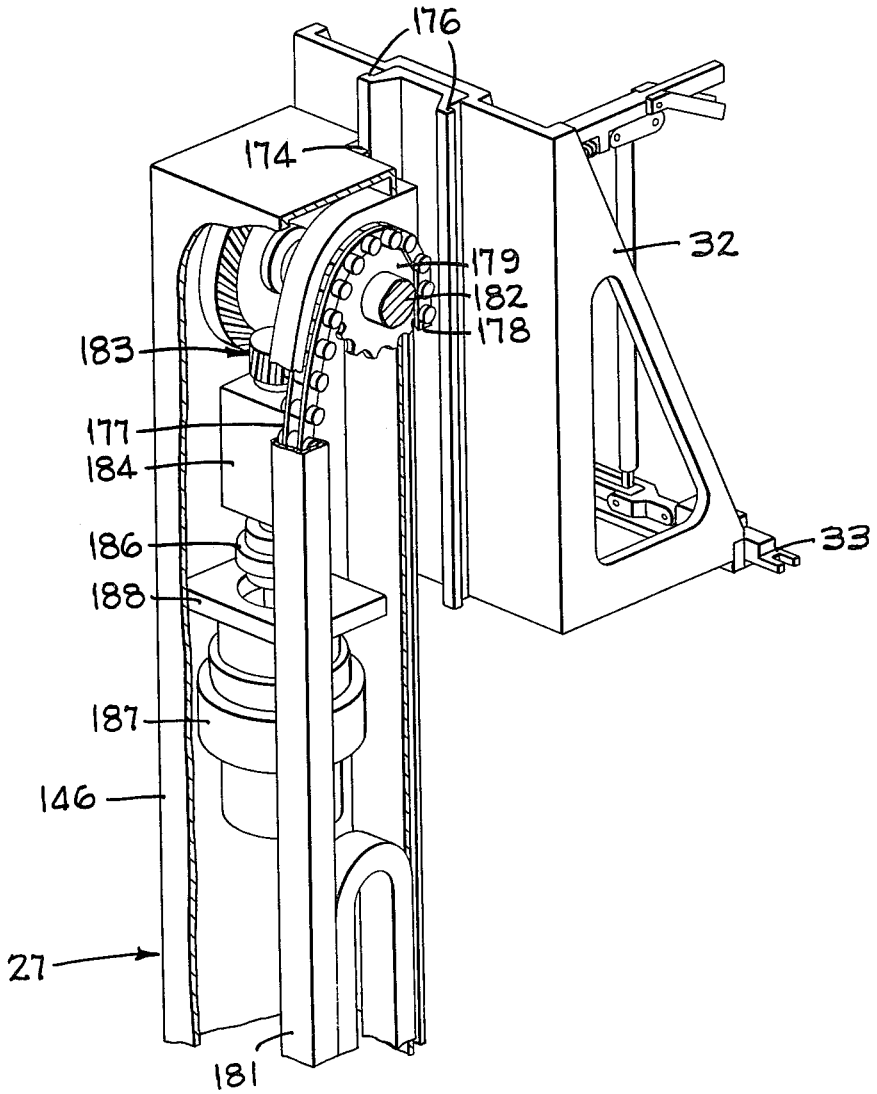
FIG. 13 is an enlarged perspective section taken along the line 13—13 of FIG. 3.

Turning now to FIG. 13 the upper portion of the cradle 146 is shown having a pair of U-shaped tracks 174 (only one shown) on one face thereof which are formed to engage and retain a pair of elongate flanges 176 attached to the hoist pawl 32. The hoist pawl is therefore disposed for movement along the length of the carriage as the flanges 176 slide along the U-shaped tracks 174. A hoist roller chain 177 is attached to the hoist pawl at a point 178 and is led around a drive sprocket 179 into a roller chain track 181. The drive sprocket is mounted on a shaft 182 which is mounted for rotation within the cradle. A gear portion of a skew axis gear set 183 is attached to the shaft 182. The pinion portion of the skew axis gear set is engaged with the gear portion and is driven through a bearing block 184 and a coupling 186 by a hydraulic motor 187 mounted on a mounting block 188 fixed to the inside of the cradle. As the hydraulic motor is driven in one direction the roller chain 177 will be played out from the roller chain track to allow the hoist pawl 32 to be lowered on the cradle 146. Conversely as the hydraulic motor 187 is rotated in the opposite direction the roller chain will be retracted to a position within the roller chain track to cause the hoist pawl to be raised in the tracks 174 on the cradle.

Figure 14:
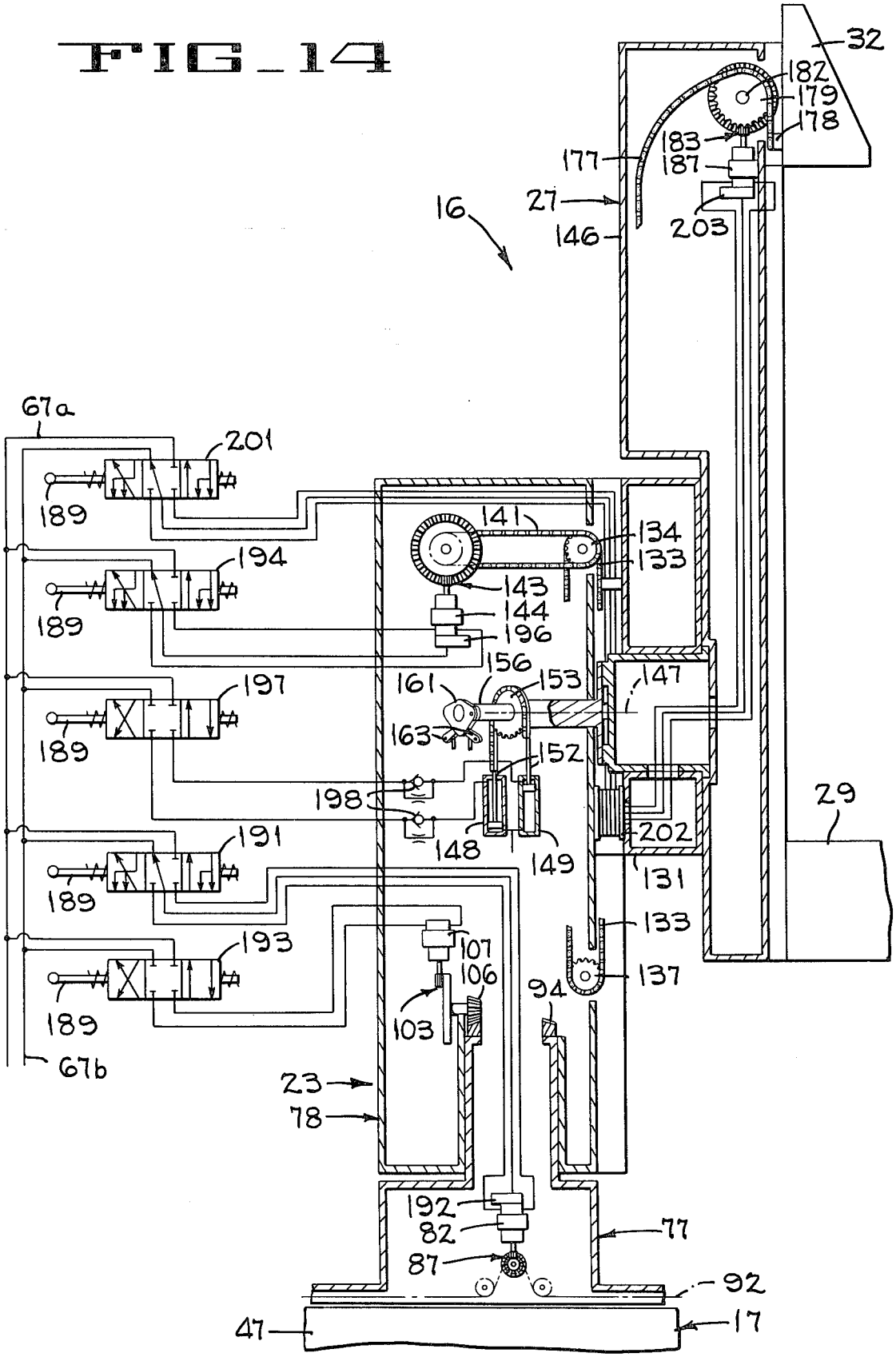
FIG. 14 is a hydraulic schematic of the service mechanism drives and drive controls in the present invention.

With reference now to FIG. 14 the manner in which the various movable portions of the service mechanism are driven will be explained. The hydraulic lines, as hereinbefore described include a pressure line 67*a* and a return or tank line 67*b*. As also hereinbefore described the base assembly 17 is moved on the tracks 21 to selected positions overlying the array of missile housings 12 by manual actuation of the hand crank wheels 34 (FIG. 2). All other movements of the service mechanism as it functions in the operational mode are powered. In this embodiment the power for moving the lower carriage 77 translationally on the base, the upper carriage 78 rotationally on the lower carriage, the cradle elevator 131 elevationally on the upper carriage, the cradle 146 rotationally on the elevator and the hoist pawl 32 along the length of the cradle is all provided hydraulically.

The pressure and tank lines are coupled to each of five manually positioned valves having handles 189 thereon for controlling the valve positions with a push-pull motion for purposes of this disclosure. The valves are each three position valves being spring loaded to a neutral or unactuated position as shown in FIG. 14. Valve 191 (typical) is connected to the hydraulic lower carriage drive motor 82 and to the output shaft brake 192 thereon which is conventional design. It may be seen that when valve 191 is in a neutral position as shown, the line from the brake is coupled to the tank line 67*b* so that pressure is relieved from the brake and a self contained spring sets the brake against the motor shaft. Both tank and pressure lines 67*a* and 67*b* are seen to be blocked from the motor 82 when the valve is in the neutral position. When the handle for the valve 191 is pushed to the right as seen in FIG. 14 pressure is directed to the brake 192 and to one side of the motor. When the handle for valve 191 is pulled to the left as seen in FIG. 14 pressure is still delivered to the brake 192 but the pressure through the motor 82 is directed in the opposite direction causing an opposite output shaft rotation. Therefore actuation of valve 191 will drive the lower carriage 77 translationally in one of two opposite directions along the tracks 36 atop the base assembly 17 when the service mechanism is in the operational mode.

Valve 193 is connected to the hydraulic upper carriage rotational drive motor 107 (FIG. 3). It may be seen that pushing the handle 189 of valve 193 to the right in FIG. 14 will result in one hydraulic pressure sense to the motor 107 and pulling the valve to the left will result in the opposite sense of hydraulic pressure to the motor. Therefore positioning valve 193 in one position will cause rotation of the upper carriage 78 in one direction and positioning the valve in the opposite position will cause opposite rotation of the upper carriage through the skew axis gear set 103 and the bevel gears 106 and 94.

Actuation of valve 194 in FIG. 14 will effect the output shaft rotation of the hydraulic motor 144 which operates to elevate the cradle elevator 131 through the skew axis gear set 143, drive chain 141, sprockets 134, and the endless chain 133 to which the cradle elevator is attached. Motor 144 has a brake 196 attached thereto which is set when brake pressure is communicated with the tank line 67*b*. Thus, the elevation position of the elevator 131 will be retained by positive braking action at any position at which the elevator raising or lowering is stopped.

Rotation of the cradle 146 is accomplished by directing hydraulic pressure to one of the two cylinders 148 or 149. Pressure is directed to one or the other of the two cylinders to retract its respective rod 152 and rotate the trunnion drive shaft through the chain 153 coupled between the ends of the rods in accordance with the position selected for the valve 197. A check valve 198 is provided in each of the lines to the pistons 148 and 149 which is spring loaded to a closed position and therefore controls the rotation speed of the cradle 146. Restricted orifice paths are provided around each of the check valves as shown so that pressure is gradually equalized on either side of the check valves when the valve 197 is returned to neutral and the trunnion drive shaft is latched in one of its two orthogonally disposed positions. The lower end of each of the cylinders is communicated with the return line 67*b*. Positive locking of the cradle with the cradle long axis either vertically or horizontally disposed is accomplished through the use of the latching mechanism attached to the end of the splined trunnion drive shaft 156 and engaging the pair of latch members 163 as hereinbefore described.

Hydraulic pressure and return is communicated through valve 201 to a take up reel 202 similar to the reels 68 and 72 hereinbefore described. Three hydraulic lines are coupled to the valve 201 and are directed around appropriate pullies (not shown) for negotiating turns enroute to the take up reel 202. The take up reel is mounted on the cradle elevator 131 having a spring motor similar to motors 71 and 73 and operates to play out the three hydraulic lines when the cradle elevator 131 is moving in one direction and to retrieve the three lines when the cradle elevator is moving in the opposite direction. The three lines are led off of the take up reel along the axis 147 of the trunnion drive shaft 156 into the cradle 146. Two of the three lines are attached to the hydraulic drive motor 187 for the hoist pawl 32 and the remaining line is connected to a brake 203 for the output shaft of the hydraulic motor 187. Since the cradle rotates only through 90° the hydraulic lines flex surfficiently to withstand the right angle twist on the axis 147 without difficulty. The brake 203 is communicated with tank pressure when the valve 201 is in the unactuated or neutral position as shown in FIG. 14. With the valve actuated on either of the other directions (push or pull) pressure is applied to the brake 203 and the brake is released so that the output shaft from the motor 187 may be rotated. A push control clearly causes the pressure to be applied in one direction through the motor and a pull control causes pressure to be directed through the motor in the opposite direction so that opposite rotation of the motor shaft is obtained by the push and the pull control commands. In this fashion the chain 177 is driven through the skew axis gear set 183 and the sprocket 179 to raise and lower the hoist pawl 32.

Figure 15:
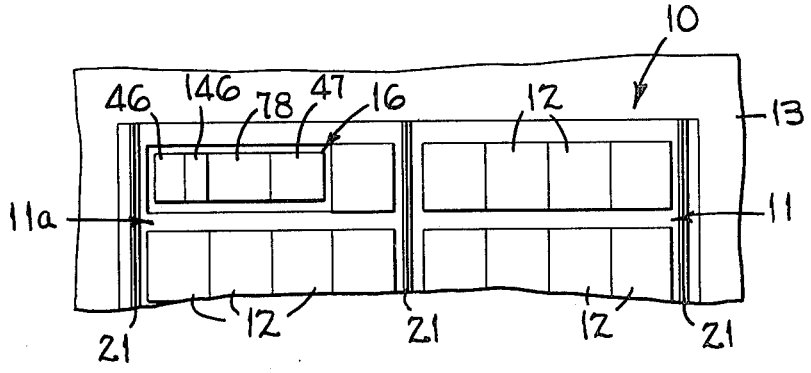
FIG. 15 is a partial plan view of a vertical launch system showing a stowed configuration of the present invention.
Figure 17:
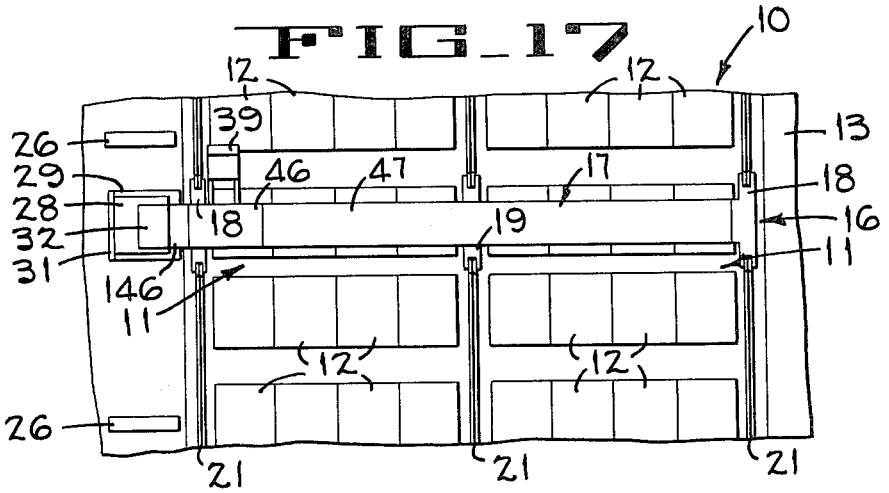
FIG. 17 is a partial plan view of a vertical launch system showing another operating configuration of the present invention.

FIG. 15 shows a plan view of the service mechanism in the stowed condition within the volumetric confines of three of the missile housings 12 within the service mechanism module 11*a*. The view of FIG. 15 is similar to that of FIG. 21 without a hatch cover. A view of the service mechanism 16 is shown in FIG. 17 as it appears immediately after raising it to deck level and assembling it into its operational mode. It should be noted that the long base end section 47 is folded downwardly, the end roller sets 18 and the mid roller set 19 are fixed in place to support the service mechanism above the vertical launching system array on the tracks 21, the operators chair 39 is installed on the upper carriage and the fork 29 is assembled on the cradle.

FIG. 16 shows the service mechanism 16 positioned at a location along the tracks 21 so that when the cradle elevator 131 is raised to its highest position and the cradle 146 is rotated to dispose its long axis in a horizontal direction, the cradle elevator may be lowered to a position so that the fork 29 will be at a level to properly engage a missile cannister 28 resting on the receiving point chocks 26. With releasable cross bar 31 engaged across the ends of the fork and the forks 33 (FIG. 13) on the hoist pawl 32 engaging the studs on the top portion of the missile cannister, the cradle elevator 131 is raised and the cradle is rotated so that its longitudinal axis is disposed vertically once again. The base 17 and the lower carriage 77 may then be moved in x-y directions until one of the funnels 38 overlies the missile housing 12 (with the hatch opened) in which the missile cannister is to be deposited. Rotation of the upper carriage 78 to a position so that the missile cannister overlies the appropriate funnel 38 completes the translational positioning of the cannister. Thereafter the hoist pawl 32 is lowered together with the cradle elevator to lower the missile cannister completely within the selected missile housing. It may be readily seen that withdrawal of missile cannisters 28 from selected ones of the missile housings 12 may be carried out by simply reversing the aforedescribed process so that the withdrawn missile cannister is displaced from a missile housing and brought to rest on the receiving point chocks 26.

Figure 18:
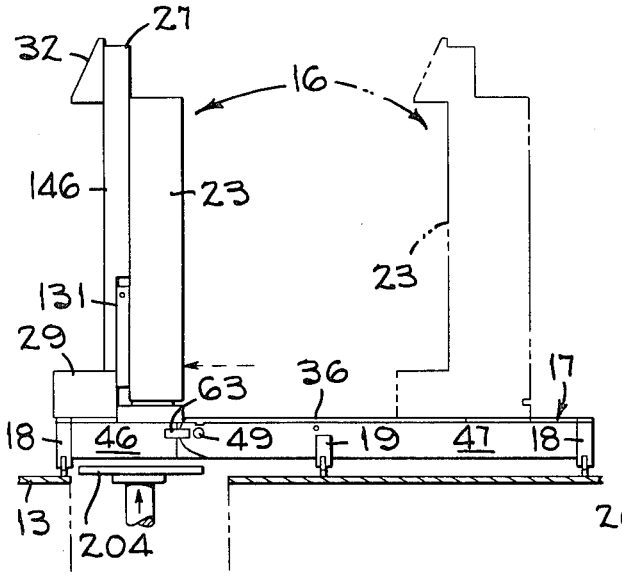
FIG. 18 is a side elevation view showing the initial steps in attaining a stowed configuration of the present invention.

With reference now to FIGS. 18–21 the steps involved in "strikedown" or placing the service mechanism 16 into its stowed configuration will be described. The strikedown mechanism is shown in FIG. 18 with the lower carriage disposed at some arbitrary position along the length of the base assembly 17. The strikedown hatch cover 14 (FIG. 1) is opened and an underlying elevator 204 attached by means of telescoping piston (not shown) to the ships structure below the deck 13 is brought to a level just above the deck level as shown in FIG. 18. The carriage assembly 23 and the base assembly 17 are moved in their respectively orthogonal directions so that the carriage assembly overlies the volume alloted for service mechanism stowage in the module 110 (FIG. 1). The elevator 204 is brought up to contact the underside of the short base end section 46. The forks 29 and releasable cross bar 31 are removed from the cradle. The detachable operator's chair 39 and funnels 38 are removed from the carriage. The end roller sets 18 and the middle roller set 19 are detached from their respective base end sections. Some of the detached parts are attached to stowage points on structure within the base assembly as well as on designated positions on the surface of the cradle as will be hereinafter described. The cradle elevator 131 is lowered to its lower most position and a pair of lifting links 206 are connected at their ends to a point on each side of the cradle elevator and a point on each side of the long base end section 47. The key 63 is removed from the aligned keyways 56 and 57 in the short and long base end sections 46 and 47 respectively. The short base end section is secured to the elevator platform by some means such as the bolts 207 shown in FIG. 19. The elevator cradle is raised thereby drawing the long base end section 47 toward a vertically disposed position as it pivots about the pivot pin 49. When the long base end section is in the vertically disposed position the key 63 is inserted in the now aligned keyways 56 and 64 in the short and long base end sections 46 and 47 respectively to thereby secure the long base end section in a stowed position along side the carriage assembly 23. The links 206 are removed from the cradle elevator and the long base end section. The cradle elevator 131 is lowered to its lower most position thereby bringing the cradle 146 in its vertically disposed position to its lowest point.

Figure 21:
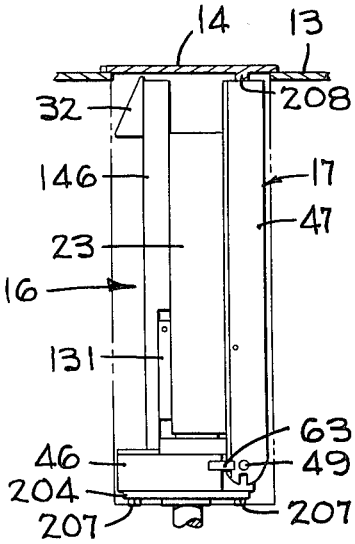
FIG. 21 is a side elevation view showing the stowed configuration of the present invention.
Figure 22:
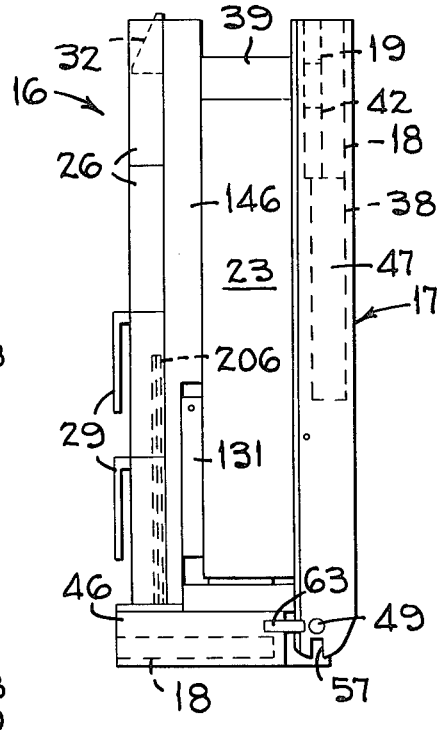
FIG. 22 is a side elevation view showing location of detachable hardware in the stowed configuration of the present invention.

When the long base end section 47 is in the stowed position along side the carriage assembly 23 and the cradle elevator is in its lower most position with the various detached items attached to structure within the base assembly as well as to designated points on the surface of the cradle, the assembly is configured as shown in FIG. 22. One of the end roller sets 18 is stowed inside the short base end section 46 while another is stowed within the long base end section 47. The mid roller set 19 is stowed within the long base end section adjacent to the rolled up drive chains 42 normally disposed along the rails 21. The missile cannister locating funnels 38 are contained within the volume indicated in FIG. 22 and the operator's chair 39 is stowed atop the carriage assembly 23 between the cradle and the stowed long base end section. The deck chocks 26 are attached to the outer surface of the cradle 146 and the fork members 29 from each side of the cradle are also attached to the same surface on the cradle. The lifting links 206 are stowed adjacent the face of the cradle as shown in FIG. 22. In this configuration the service mechanism 16 is lowered on the elevator 204 to bring the upper-most portion of the mechanism in the stowed configuration to a point just below the deck 13. Thereupon the hatch 14 is placed over the volume containing the stowed service mechanism as seen in FIG. 21 and a locking spud 208 on the underside of the hatch cover 14 is brought into contact with a mating point formed at the end of the long base end section 47. The stowed service mechanism is therefore engaged at the top by the hatch cover 14 and at the bottom by the fastening means 207 extending from the elevator 204. The service mechanism may therefore be seen to be capable of being configured in the stowed mode as seen in FIG. 21 and the operational mode as best illustrated in FIG. 2. The steps for assuming the operational mode from the stowed mode of FIG. 21 are simply the reverse of the foregoing steps described for changing from the operational mode to the stowed mode. From the foregoing it should be clear that the service mechanism in the operational mode is utilized to service the missile housings 12 in the vertical launching system array and following such servicing the mechanism is reconfigured to be stowed within the volume normally defined by three of the missile housings 12.

Although the best modes contemplated for carrying out the present invention have been herein shown and described, it will be apparent that modification and variation may be made without departing from what is regarded to be the subject matter of the invention.

We claim:

1. A service mechanism adapted to interface with a vertical launching system having an array of missile housings storing missiles in a launching condition, comprising a base assembly, said base assembly being adapted to move bidirectionally over the array of missile housings when in an operational condition, one end of said base assembly being movable relative to the other end to assume a stowed condition, a carriage assembly mounted to move bidirectionally on said base assembly when said base is in said operational condition so that said carriage may be positioned proximate to each missile housing in the array, a cradle assembly mounted on said carriage, and means on said cradle assembly for providing raising and lowering movement of said cradle assembly and a missile relative to said carriage, said cradle assembly being adapted to securely engage the missile so that the missile may be moved between a receiving position displaced from the array and ones of the missile housings.

2. A service mechanism as in claim 1 wherein said base assembly comprises first and second sections, said first section being movable between said stowed condition adjacent said carriage assembly when said carriage is positioned on said second section and an extended position substantially in alignment with said second section when said base is in said operational condition.

3. A service mechanism as in claim 1 wherein said means for providing raising and lowering movement comprises a cradle elevator mounted for vertical movement on said carriage assembly, a cradle member adapted to surround and support the missile, and a hoist pawl adapted to connect to the missile attached to said cradle, and configured for vertical movement thereon so that the missile may be lowered or raised by any combination of cradle elevator and hoist pawl movements.

4. A service mechanism as in claim 1 wherein said carriage assembly comprises a lower section and an upper section, means for pivotally mounting said upper section on said lower section and for providing azimuthal rotation of said upper section thereon, and means for coupling said lower section to said base assembly and for providing movement of said lower section along said base when said base is in said operational condition.

5. A service mechanism as in claim 1 wherein said cradle assembly comprises a cradle elevator mounted for raising and lowering movement on said carriage assembly, a cradle member adapted to engage the missile, and a cradle trunnion rotationally coupling said cradle elevator with said cradle member, whereby said cradle assembly movement relative to said carriage is both translational and rotational.

6. A service mechanism as in claim 5 together with means for limiting said cradle rotational movement to 90 degrees.

7. A service mechanism as in claim 4 together with means for limiting said azimuthal rotation of said carriage assembly upper section to 360 degrees.

8. A service mechanism for a vertical launching system having an array of missile housings for accepting missiles and being convertible between operating and stowed configurations, comprising a base assembly, first and second sections in said base assembly releasably locked in one of an extended condition in the operating configuration and a folded condition in the stowed configuration, a carriage assembly extending upwardly from said base assembly and having means for engaging said base assembly and for providing movement therealong when said base assembly is in said extended condition, a cradle elevator mounted for substantially vertical movement on said carriage assembly, a cradle adapted to engage the missiles and mounted for rotational movement on said cradle elevator, whereby missiles may be engaged and moved between a receiving point adjacent said array and ones of said missile housings, and means for positioning said first base assembly section between said extended and folded conditions when said second base assembly section is supporting said carriage assembly, so that said first base section, carriage assembly and cradle are in substantially aligned side-by-side position when in the stowed configuration.

9. A service mechanism as in claim 8 wherein said means for positioning comprises a link connected between said first base assembly section and said cradle, whereby said first base section is raised to said folded condition when said cradle elevator is raised, said first base section, carriage assembly, cradle elevator and cradle combined cross sections being smaller than and fitting within the cross section of a predetermined number of missile housings, and said first base section, carriage assembly, cradle elevator and cradle overall height with the cradle elevator lowered being less than the height of a missile housing.

10. A service mechanism as in claim 8 together with means for limiting said cradle rotation to 90 degrees.

11. A service mechanism as in claim 8 wherein said carriage assembly comprises a lower carriage and an upper carriage, and means disposed between said upper and lower carriages for providing rotation of said upper carriage in azimuth.

12. A service mechanism as in claim 11 together with means for limiting said upper carriage rotation to 360 degrees.

13. A service mechanism as in claim 11 together with means for latching said upper carriage at 90 degree increments of rotation.

14. A service mechanism for a vertical missile launching system having an array of missile cannister housings wherein tracks are laid out on a surface adjacent the array of housings and a power receptacle is accessible on the surface, comprising a base including means adapted to engage the tracks so that said base may be moved over the surface on the tracks, a carriage supported on said base for movement therealong in a direction angularly disposed from the direction of the tracks, an upper portion on said carriage being movable in azimuth with respect to a lower portion, a cradle movably mounted on said carriage upper portion adapted to engage and transport a missile cannister between a receiving position and ones of the cannister housings, and means coupled to the power receptacle for moving said carriage and cradle to effect transport of the cannisters, said base, carriage and cradle being selectively movable relative to each other and the array to assume a stowed configuration.

15. A service mechanism as in claim 14 together with an elevator for receiving and holding said base assembly when in said stowed condition and operating to selectively position said base, carriage and cradle above and below the surface.

16. A service mechanism as in claim 14 wherein said stowed configuration provides a volume within that defined by three of the cannister housings.

17. A service mechanism as in claim 14 wherein said cradle includes a hoist pawl adapted to engage one end of the missile cannister, said hoist pawl being movable on said cradle so that the missile cannister may be selectively raised and lowered in the vertical position.

18. A service mechanism as in claim 14 wherein said base includes manually engageable means for imparting motion to said base along the tracks.

19. A service mechanism as in claim 14 wherein said base, carriage and cradle each include detachable portions together with means formed on each of said base, carriage and cradle for attaching and storing said detachable portions in said stowed configuration.

20. A service mechanism as in claim 14 wherein the array of cannister housings is grid-like and wherein said base and tracks have orthogonally disposed long dimensions, whereby said carriage movement direction is orthogonal to said base movement direction.

21. A service mechanism as in claim 14 wherein said cradle comprises a cradle elevator mounted for vertical motion relative to said carriage upper portion and a swinging cradle member pivotally mounted on said cradle elevator and movable between vertical and horizontal alignment positions.

22. A service mechanism as in claim 14 wherein said carriage comprises means for pivotally supporting said carriage upper portion and means for selectively moving said upper portion in azimuth.

23. A service mechanism as in claim 22 wherein said means for pivotally supporting comprises means for limiting said upper carriage to 360° motion in azimuth and means for latching said upper carriage at predetermined positions within said motion limits.

24. A service mechanism for interfacing with a vertical launching system having a grid-like array of missile cannister housings formed to accept missile cannisters and having a set of parallel tracks running along the array comprising a base disposed across and overlying the set of tracks, means disposed between said base and tracks providing movement of said base to selected positions along the tracks, a lower carriage mounted on said base for linear movement thereon in a direction substantially orthogonal to the parallel tracks, an upper carriage pivotally mounted on said lower carriage and movable rotationally relative to said lower carriage so that said upper carriage may assume selected azimuth positions, a cradle elevator disposed for raising and lowering motion on said upper carriage, and a cradle mounted on said cradle elevator adapted to engage and support a missile cannister, said cradle being disposed for rotation between positions wherein the cannister long dimension is oriented horizontally and vertically, said base comprising a displaceable end and a support end, means for positioning said displaceable end between a lowered operational position and a raised stowed position whereby cannisters may be moved between the cannister housings and a loading position adjacent the grid-like array when said base is positioned in said operational position and the service mechanism may be stowed when said base is in said stowed position.

25. A service mechanism as in claim 24 wherein said means for positioning said displaceable end comprises a link which may be connected between said displaceable end and said cradle elevator, and means for pivoting said displaceable end on said support end so that when said link is connected and said cradle elevator is raised said displaceable end assumes said raised stowed position.

26. A service mechanism as in claim 24 wherein said means disposed between said base and tracks are detachable, together with means accessible when said base is in said stowed position for securing said detachable means in said stowed position.

27. A service mechanism as in claim 24 together with a hoist pawl mounted on said cradle and disposed for movement therealong, and means on said hoist pawl for engaging a missile cannister so that the cannister is movable vertically when said cradle is disposed with its long dimension oriented vertically.

* * * * *